US006340139B1

(12) United States Patent
Hilleary

(10) Patent No.: US 6,340,139 B1
(45) Date of Patent: Jan. 22, 2002

(54) HIGHWAY GRADE CROSSING VEHICLE VIOLATION DETECTOR

(75) Inventor: Thomas N. Hilleary, Chesterfield, MO (US)

(73) Assignee: LaBarge, Inc., St. Louis, MO (US)

( * ) Notice: Subject to any disclaimer, the term of this patent is extended or adjusted under 35 U.S.C. 154(b) by 0 days.

(21) Appl. No.: 09/584,865

(22) Filed: Jun. 1, 2000

(51) Int. Cl.[7] ..... B61L 29/08

(52) U.S. Cl. ..... 246/292; 246/293; 246/125; 246/473.1; 246/294; 246/295

(58) Field of Search ..... 246/120, 121, 246/125, 292, 293, 294, 295, 296, 473.1, 486

(56) References Cited

U.S. PATENT DOCUMENTS

| | | | | |
|---|---|---|---|---|
| 3,964,704 A | | 6/1976 | Karr | |
| 4,090,685 A | * | 5/1978 | Pappas | 246/125 |
| 4,897,960 A | | 2/1990 | Barvinek et al. | |
| 4,942,395 A | * | 7/1990 | Ferrari et al. | 340/907 |
| 5,274,271 A | | 12/1993 | McEwan | |
| 5,332,938 A | | 7/1994 | McEwan | |
| 5,345,471 A | | 9/1994 | McEwan | |
| 5,361,070 A | | 11/1994 | McEwan | |
| 5,457,394 A | | 10/1995 | McEwan | |
| 5,465,094 A | * | 11/1995 | McEwan | 342/28 |
| 5,512,834 A | | 4/1996 | McEwan | |
| 5,519,400 A | | 5/1996 | McEwan | |
| 5,521,600 A | | 5/1996 | McEwan | |
| 5,523,760 A | | 6/1996 | McEwan | |
| 5,576,627 A | | 11/1996 | McEwan | |
| 5,581,256 A | | 12/1996 | McEwan | |
| 5,589,838 A | | 12/1996 | McEwan | |
| 5,682,164 A | | 10/1997 | McEwan | |
| 5,729,213 A | * | 3/1998 | Ferrari et al. | 340/901 |
| 5,754,144 A | | 5/1998 | McEwan | |
| 5,757,320 A | | 5/1998 | McEwan | |
| 5,764,162 A | * | 6/1998 | Ehrlich | 340/933 |
| 5,774,091 A | | 6/1998 | McEwan | |
| 5,805,110 A | | 9/1998 | McEwan | |
| 5,890,682 A | | 4/1999 | Welk | |

OTHER PUBLICATIONS

"Micropower Impulse Radar: 'Genie on a Chip' technology opens many new doors for U.S. industry" at URL http://www.llnl.gov/IPandC/op96/10/10o–mic.html as of Nov. 28, 1998.

"Micropower Impulse Radar (MIR)" at URL http://www–lasers.llnl.gov/lasers/idp/mir/mir.html as of Nov. 11, 1998.

"Micropower Impulse Radar: MIR Technology Overview" at URL http://lasers.llnl.gov/lasers/idp/mir/overview.html as of Nov. 11, 1998.

"Micropower Impulse Radar: MIR FAQ'3" at URL http://lasers.llnl.gov/lasers/idp/mir/faqs.html as of Nov. 11, 1998.

"Micropower Impulse Radar"; Science & Technology Review Jan./Feb. 1996; pp. 16–27.

"Micropower Impulse Radar: Electronic trip wire"at URL http://lasers.llnl.gov/lasers/idp/mir/tripwire.html as of Nov. 11, 1998.

"Micropower Impulse Radar: MIR Strip Proximity Sensor (Smart Wire)"at URL http://lasers.llnl.gov/lasers/idp/mir/smartwire.html as of Nov. 11, 1998.

"Micropower Impulse Radar: Range gated field disturbance sensor"at URL http://lasers.llnl.gov/lasers/idp/mir/range.html as of Nov. 11, 1998.

24 GHz Radar Rangefinder; TEM Innovations; May 1999.

* cited by examiner

*Primary Examiner*—S. Joseph Morano
*Assistant Examiner*—Frantz F. Jules
(74) *Attorney, Agent, or Firm*—Armstrong Teasdale LLP

(57) ABSTRACT

In one embodiment, the present invention is an alarm monitor for a railroad grade crossing, the grade crossing having an island activation relay that is activated in response to an approaching train, the alarm monitor including a micropower impulse radar (MIR) responsive to pedestrians and motor vehicles in a prohibited area of the crossing island during activations of the island activation relay; and a processor configured to generate a warning signal when the MIR detects a pedestrian or a motor vehicle in the prohibited area during an activation of the island activation relay.

18 Claims, 5 Drawing Sheets

HIGHWAY GRADE CROSSING VEHICLE VIOLATION DETECTOR

BACKGROUND OF THE INVENTION

This invention relates generally to means and apparatus for detecting a location of a vehicle, and more particularly to detecting the unsafe or illegal presence of a vehicle in a railroad grade crossing.

A majority of train-vehicle accidents at grade crossings occur when drivers ignore or do not observe warning systems such as gates, flashing lights, or warning signs. The railroad industry and state transportation authorities regularly engage in construction projects to increase the level of safety as these intersections, particularly drawing on accident statistics as a means of prioritizing potential improvement projects. With the advent of inexpensive monitoring systems that operate over channels on the nation's cellular telephone infrastructure, a means exists by which data pertaining to crossing violations can be delivered to recipients who would find such information very valuable. Adding an effective means of detecting such an occurrence to a communications device requires a more precise detection device that can withstand wide temperature and environmental extremes faced in such an application while maintaining sharply bounded detection zones.

Previous means of accomplishing this task have been hindered by the cost and lack of precision of other detection technologies such as infrared, light beams and photocells, and microwave security intrusion sensors. The accuracy and repeatability of these technologies vary widely over time, temperature, and weather conditions. Ice, snow, rain, and dust can render them inoperative. Buried loops can detect vehicles, but they are costly to install and maintain, and do not detect pedestrian traffic.

In addition, it would be desirable if statistics of crossing violations could be accumulated over time for remote grade crossings. If such statistics were known, it may be possible to identify "problem" crossings and to make changes to reduce the occurrence of violations.

BRIEF SUMMARY OF THE INVENTION

In one embodiment, the present invention is therefore an alarm monitor for a railroad grade crossing, the grade crossing having an island activation relay that is activated in response to an approaching train, the alarm monitor including a micropower impulse radar (MIR) responsive to pedestrians and motor vehicles in a prohibited area of the crossing island during activations of the island activation relay; and a processor configured to generate a warning signal when the MIR detects a pedestrian or a motor vehicle in the prohibited area during an activation of the island activation relay.

It will be seen that embodiments of the present invention provide a cost-effective system for detecting and reporting instances of vehicles and pedestrians violating crossing warning systems. Using these embodiments, railroad industry and state transportation authorities can learn of elevated risk situations without waiting to compile accident statistics. With such information, better decisions can be made with respect to increased enforcement, implementation of alternate warning systems, or other remedies to reduce the likelihood of accidents.

DETAILED DESCRIPTION OF THE INVENTION

Figure 1:
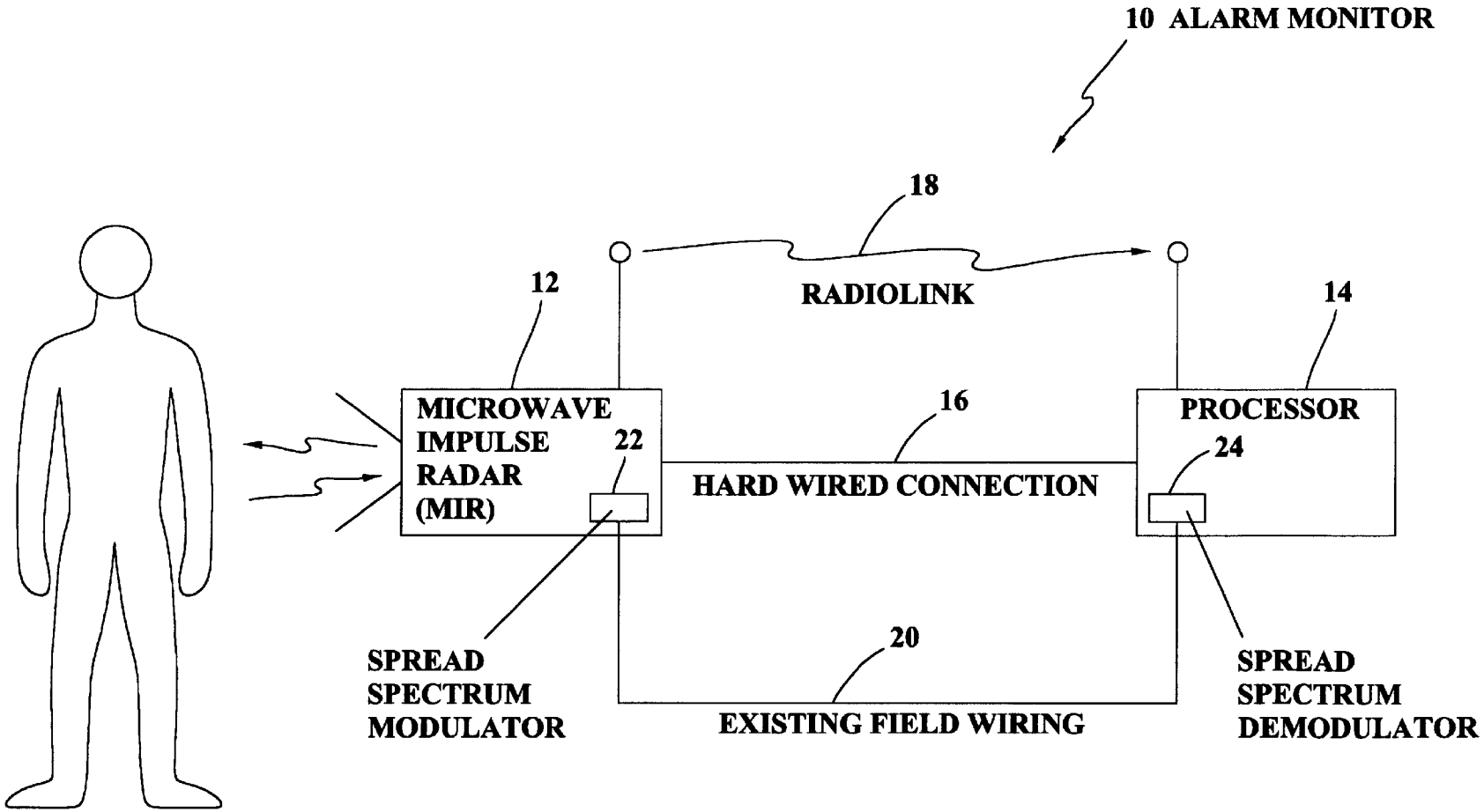
FIG. 1 is a simplified block diagram of one embodiment of an alarm monitor of the present invention.

FIG. 1 is a simplified block diagram of one embodiment of an alarm monitor 10 of the present invention. Alarm monitor 10 comprises at least one Micropower Impulse Radar (MIR) 12 that is responsive to pedestrians or vehicles in a prohibited area of a railroad grade crossing (not shown), the prohibited area being a region of the grade crossing that is dangerous for a pedestrian or vehicle to occupy during approach and passage of a train. A MIR is a device that produces a short, low power microwave impulse and that has the capability of detecting reflections from objects within a limited distance range. Such radars have the capability of detecting pedestrians and/or motor vehicles at a range of no more than about 30 feet (9 meters) due to power limitations of the radar unit itself. The range limitation is desired to reduce susceptibility to spurious signals outside of prohibited region. The limitation is also used to advantage in some embodiments to avoid reflections from the train itself, as it crosses the grade, and to avoid spurious indications due to animals that may enter a grade crossing from directions other than the highway. One example of a suitable MIR 12 is an RRF24 Rangefinder, available from TEM Innovations, Pleasanton, Calif., which has a maximum range of about 20 meters, but which can be adjusted to detect in a more limited range. Another suitable MIR is described in U.S. Pat. 5,805,110, issued Sept. 8, 1998 to Thomas E. McEwan.

MIRs 12 are also configured to transmit detection data relating to pedestrians and vehicles in the prohibited area to a nearby processor 14. Transmission is via a hardwired connection 16, via a radio link 18, or via already existing field wiring 20. Although several transmission modes are shown in FIG. 1, only one is required in any particular embodiment. In one embodiment, a spread spectrum modulator 22, for example, an INTELLON® SSC P200 modulator/demodulator (available from Intellon, Inc., Ocala, Fla.) is utilized to modulate the detection signal before transmission over connection 16, radio link 18, or field wiring 20. In this embodiment, a spread spectrum demodulator 24 (for example, also an INTELLON® SSC P200 modulator/demodulator) is used to demodulate transmissions of detection data at processor 14. (Only field wiring link 20 is shown equipped with modulator 22 and demodulator 24 in FIG. 1.)

Figure 2:
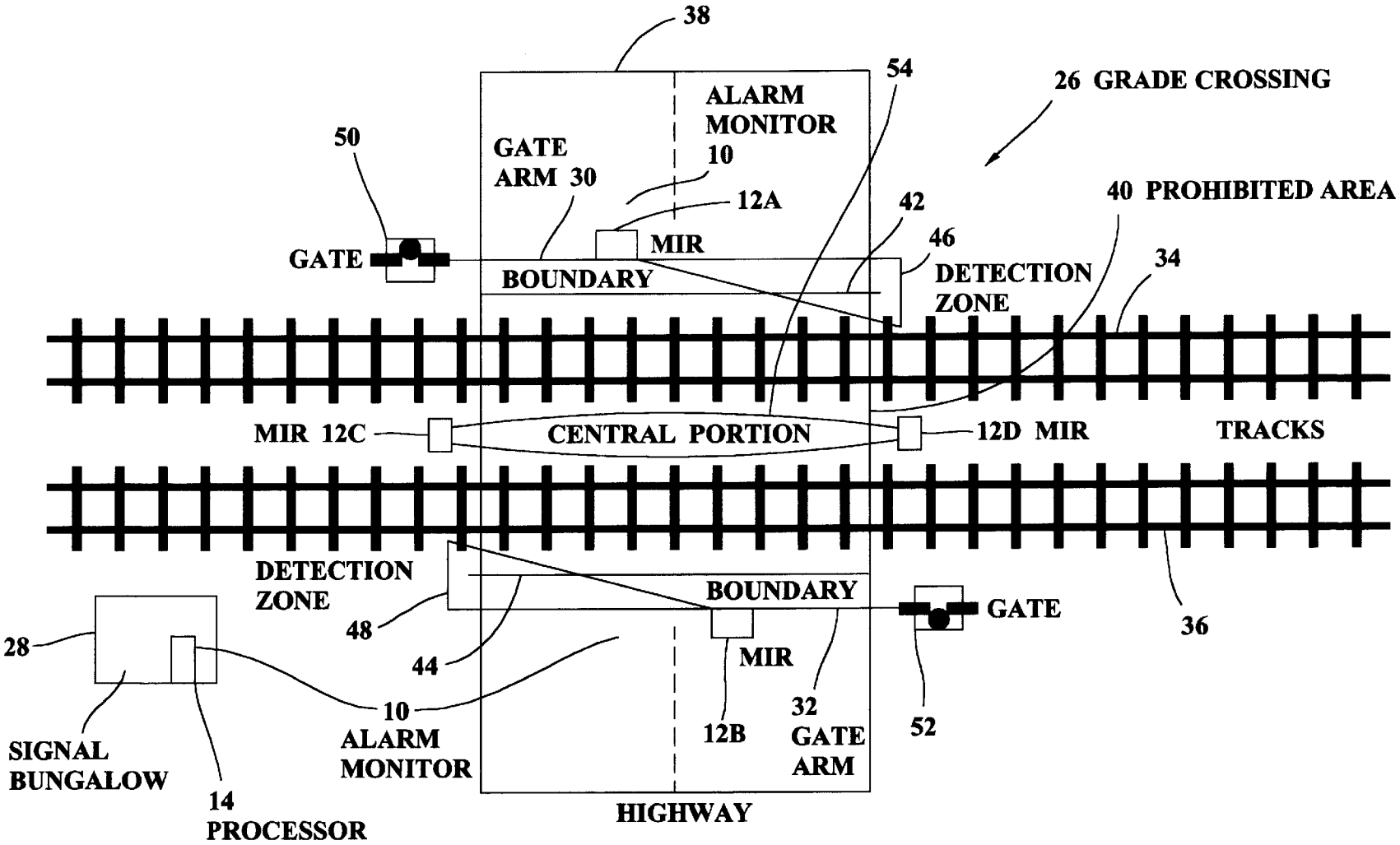
FIG. 2 is a simplified map of a grade crossing having gate arms that drop to warn approaching vehicular and/or pedestrian traffic of an approaching train, showing one technique for mounting an embodiment of an alarm system of the present invention.

Various installations of embodiments of alarm monitor 10 in a grade crossing 26 are illustrated in FIGS. 2 through 5. Referring to FIG. 2, grade crossing 26 has a signal bungalow 28 containing equipment that activates gate arms 30, 32 when a train (not shown) on either of tracks 34 or 36 activates an island activation relay (not shown). This activation causes gate arms 30, 32 to drop, blocking oncoming traffic in both directions on highway 38. However, as a safety feature, each gate arm 30, 32 on a typical grade crossing 26 only extend across a portion of highway 38. This safety feature allows a vehicle that has already entered a prohibited area 40 of grade crossing 26 to continue through on their side of the road. However, the presence of this safety feature also allows an impatient pedestrian or vehicle driver to circumvent the signaling and protection afforded by gate arms 30, 32 by changing traffic lanes and going around the gate arms. Needless to say, this practice is dangerous.

In the embodiment of FIG. 2, MIRs 12A and 12B are mounted on ends of gate arms 30, 32. MIRs 12A and 12B are positioned on these arms so that, when gate arms 30 and 32 are lowered, MIRs 12A and 12B are directed to detect objects in a narrow region around boundaries 42, 44 of prohibited area 40 on highway 38 that are not blocked by gate arms 30, 32. MIRs 12A and 12B are energized when the island activation relay (not shown) is activated, and thus become responsive to pedestrians and vehicles improperly crossing boundaries 42 and 44 when gate arms 30 and 32 are lowered.

MIRs 12A and 12B provide an advantageous configuration in that they have a combination of a relatively limited range (e.g., no more than about 6 to 9 meters, or no more than about 20 to 30 feet) and a relatively precise zone of coverage (i.e., a relatively precise angular coverage). Thus, alarm system 10 defines rather sharply defined detection zones 46, 48 that are more resistant to spurious alarms and more sensitive to actual intrusions into prohibited area 40 from highway 38 than systems using standard microwave security intrusion sensors. Furthermore, the accuracy and repeatability using MIRs 12A and 12B is greater than that obtainable using standard microwave security intrusion sensors, or infrared and light beam/photocell sensors. Unlike these sensors, MIRs are resistant to ice, snow, rain, and dust that can render these other sensors inoperative. Also, unlike buried loops, which are difficult to install and maintain, pedestrian (and bicycle) traffic is readily detected.

When intrusion into either zone 46 or 48 is detected, a detection data signal is transmitted to processor 14 inside signal bungalow 28. The transmission path is not shown in FIG. 2. However, as discussed in connection with FIG. 1, transmission is via a hardwired link, a radio link, or via field wires (not shown in FIG. 2, but shown in FIG. 1) that supply lights and gates 50, 52 with their electrical energy. In some embodiments, to ensure a metal path when transmission is via field wires, MIRs 12A and 12B contain additional circuitry to synchronize transmission of detection data with the presence of a flashing voltage on the field wires. Transmission via spread spectrum modulation, with repetitions of signals from MIRs 12A and 12B enable processor 14 in one embodiment to receive asynchronous transmissions from MIRs 12A and 12B.

In one embodiment, processor 14 makes a determination that grade crossing 26 is active. This determination is made either directly in response to the activation of the island activation relay by an approaching train (not shown), or indirectly in response to such activation, such as by sensing activity of a flashing relay (not shown). When this determination is made, and during such times that the grade crossing 26 is signaling that the train is approaching or crossing grade crossing 26, when a signal indicating an intrusion is received from either MIR 12A or 12B, processor 14 generates a warning signal. In one embodiment, the generation of a warning signal is conditioned upon the activation of the island activation relay. Also in one embodiment, the warning signal and is used to control transmission of a signal intended for reception at a location remote from grade crossing 26 to alert officials (and/or the train engineer) that a hazardous condition has just occurred. Also, the warning signal is used to increment a counter (not shown separately in FIG. 2) to keep track of the occurrences of such hazardous conditions. In one embodiment, the warning signal and the counter are both internal to processor 14 and are implemented using software or firmware. In this manner, processor 14 can be accessed at a later time to determine how many times hazardous attempts have been made to cross grade crossing 26, and a decision made to further action taken to reduce such hazardous crossing attempts based upon the stored count.

In one embodiment, the violation detection capabilities of outer MIRs 12A and 12B are augmented by one or more additional central MIRs 12C, 12D positioned and directed to be responsive to pedestrians and vehicles only within a central portion 54 of prohibited area 40. Processor 14 receives detection data from the one or more central MIRs 12C, 12D and is configured to present its alarm signal only if a central MIR 12C and/or 12D detects the presence of a pedestrian or vehicle after an outer MIR 12A or 12B has detected the pedestrian or vehicle. This further requirement for an alarm indication further reduces false alarms that may occur when a vehicle or a pedestrian is detected only when leaving grade crossing 26, or in the event a portion of vehicle or pedestrian grazes a detection zone 46 or 48 but does not cross either track 34 or 36. In one embodiment, such events are noted and recorded by processor 14, but are given a lower priority and/or are counted separately. Although central MIRs are illustrated in FIG. 2 in conjunction with an embodiment in which outer MIRs are mounted on gate arms, central MIRs are also used in other embodiments having outer MIRs having different mountings.

Figure 3:
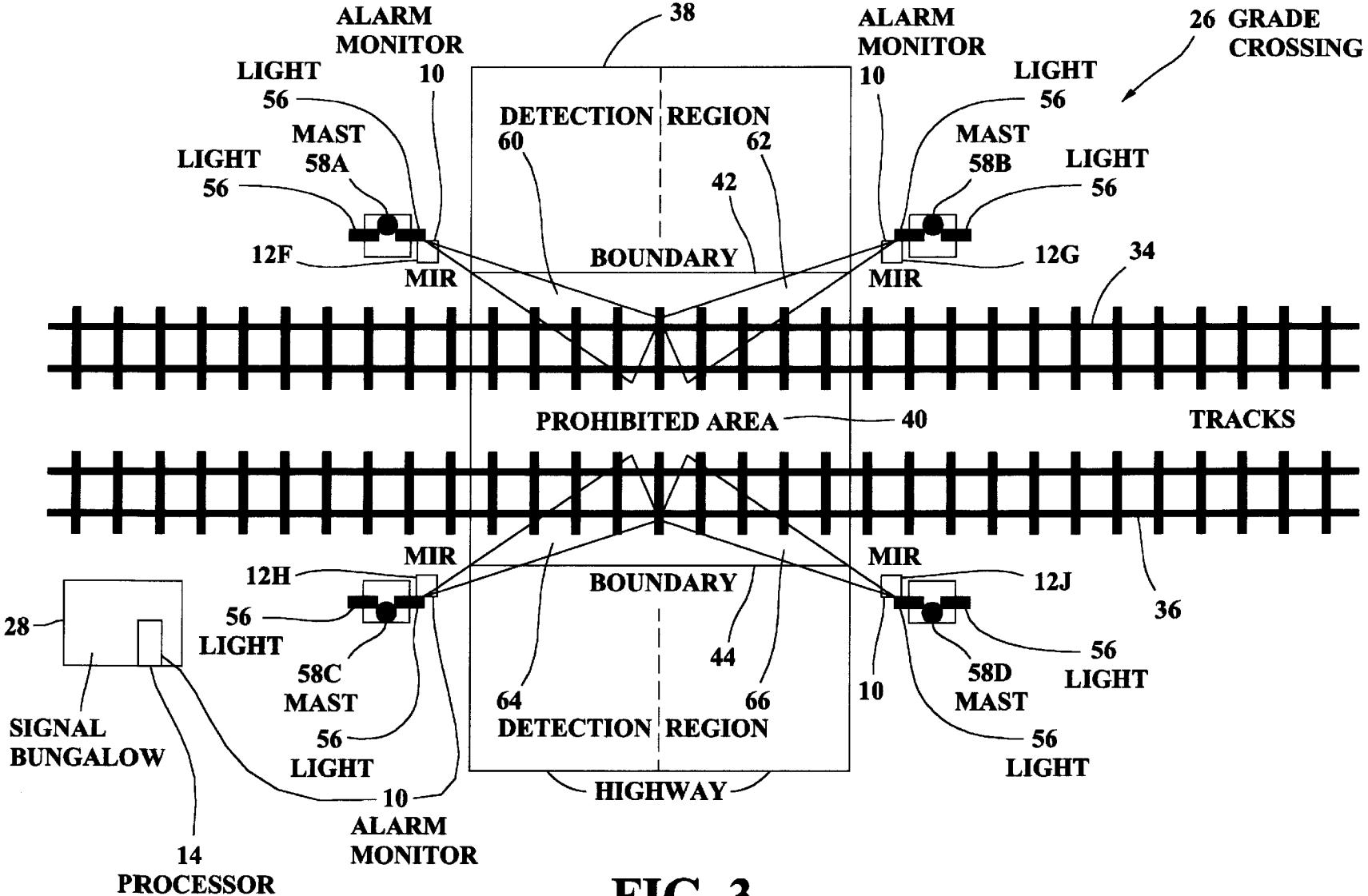
FIG. 3 is a simplified map of a grade crossing similar to that of FIG. 2, but without gate arms, showing another technique for mounting an embodiment of an alarm system of the present invention.

FIG. 3 is an illustration of an embodiment of alarm system 10 mounted on a grade crossing 26 that does not use gates or gate arms. Instead, grade crossing 26 signals the approach of a train by activating flashing lights 56 mounted on masts 58A, 58B, 58C and 58D that are located near corners of prohibited area 40. In this embodiment, MIRs 12F, 12G, 12H and 12J are mounted on masts 58A, 58B, 58C, and 58D, respectively, and are configured to detect pedestrians and vehicles in detection regions 60, 62, 64 and 66. Thus, MIRs 12F, 12G, 12H and 12J detect intrusions that occur by pedestrians and vehicles that cross a boundary of prohibited area 40 in a traffic lane nearby a corresponding mast 58A, 58B, 58C and 58D. As used herein, being "mounted on a mast" is not intended to exclude being mounted on one of the flashing lights 56 mounted on a mast.

Figure 4:
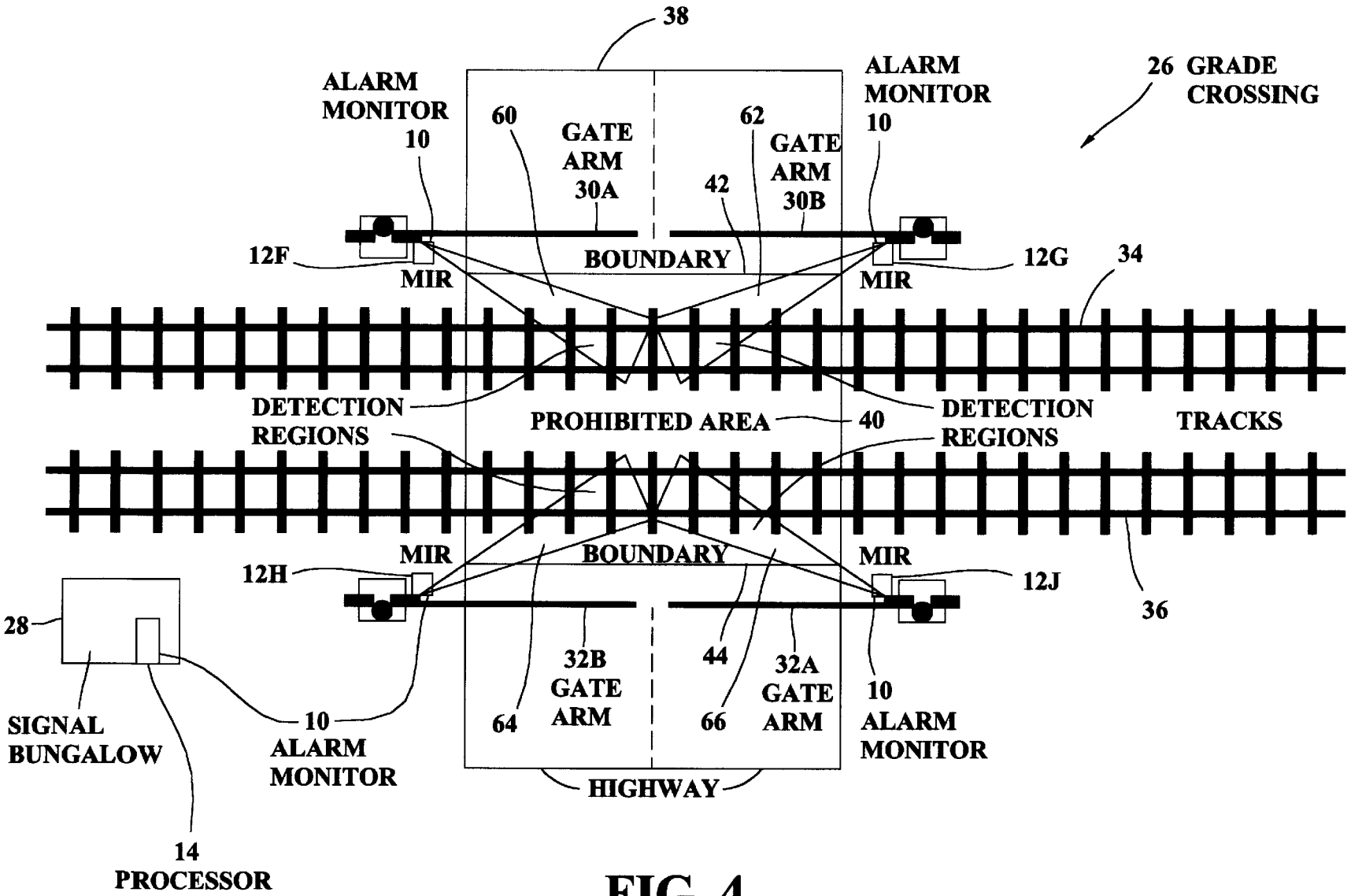
FIG. 4 is a simplified map of a grade crossing having a four quadrant gate, showing still another technique for mounting an embodiment of an alarm system of the present invention.

FIG. 4 is an illustration of an embodiment of alarm system mounted on a grade crossing 26 in a manner similar to that shown in FIG. 3. The example of FIG. 4 differs in that grade crossing 26 is provided with a four quadrant gate having four gate arms 30A, 30B, 32A, and 32B, where gate arms 30A and 32A are entrance gate arms and gate arms 30B and 32B are exit gate arms. Interference with detection regions 60, 62, 64 and 66 of MIRs 12F, 12G, 12H and 12J by gate arms 30A, 30B, 32A, and 32B is minimized because MIRs 12F, 12G, 12H and 12J are configured to have limited range and well-defined and delimited detection coverage.

Figure 5:
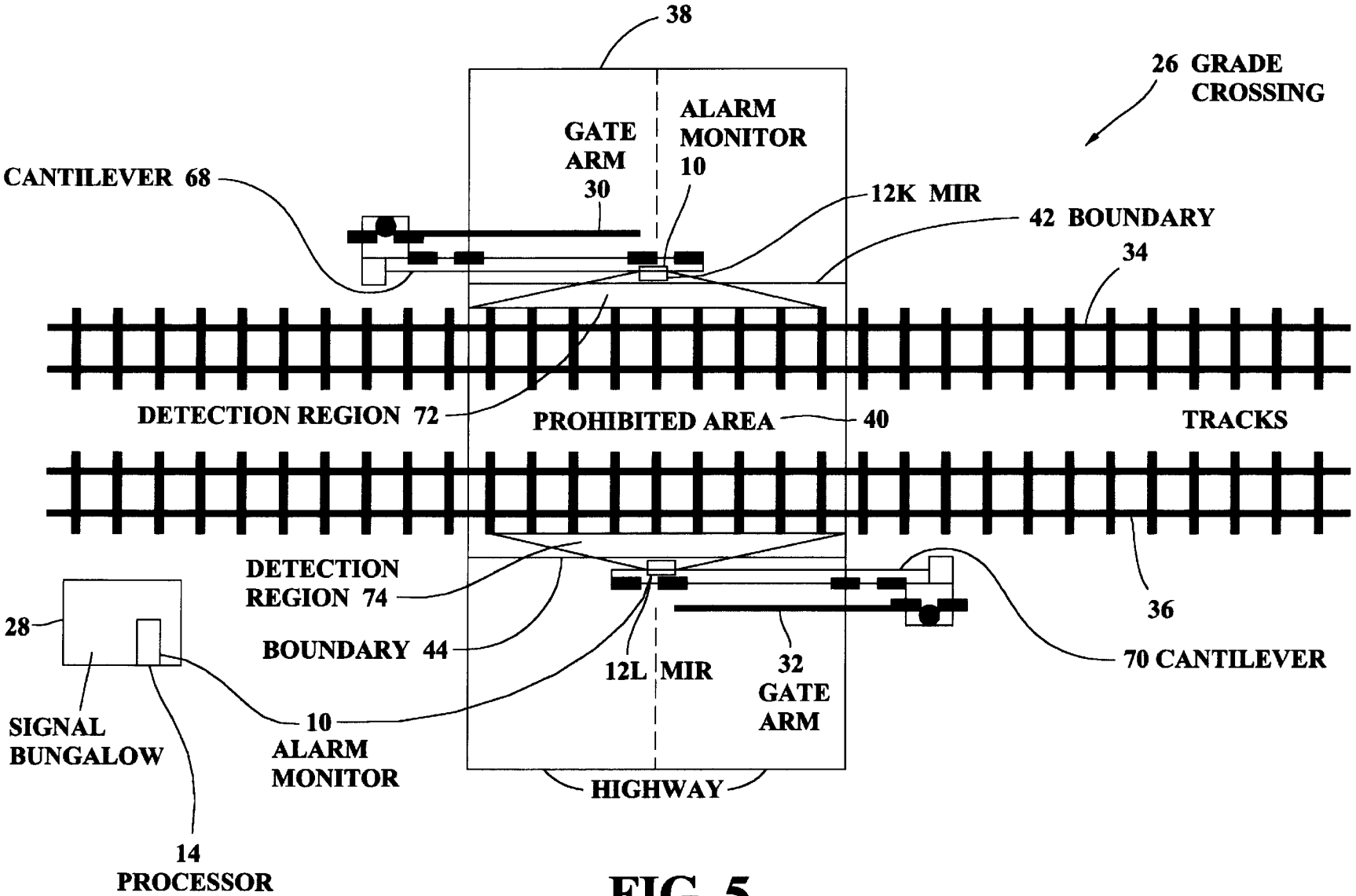
FIG. 5 is a simplified map of a grade crossing similar to that of FIG. 2, but having cantilevers crossing over a portion of a highway near prohibited edge boundaries.

The embodiment illustrated in FIG. 5 is similar to that shown in FIG. 2, except that in FIG. 5, MIRs 12K and 12L are mounted on cantilevers 68 and 70 that cross above a portion of highway 38 near prohibited area 40 boundaries 42, 44, respectively. Also, MIRs 12K and 12L are configured to have broad, but limited distance, detection regions 72 and 74 directed towards highway 38 from cantilevers 68 and 70, respectively.

It will thus be seen that embodiments of the present invention provide a cost-effective system for detecting and reporting instances of vehicles and pedestrians violating crossing warning systems. Using these embodiments, railroad industry and state transportation authorities can learn of elevated risk situations without waiting to compile accident statistics. With such information, better decisions can be made with respect to increased enforcement, implementation of alternate warning systems, or other remedies to reduce the likelihood of accidents.

The use of MIR technology by the various embodiments renders the alarm monitor impervious to rain, snow and dust, and allows it to operate in a very precise manner, maintaining very sharply defined detection zones over a wide range of environmental extremes. In embodiments in which the island activation relay is also monitored, the alarm monitor makes accurate determinations that the warning system is activated and that an object is present where it should not be. Advantageously, in some embodiments, signals from the MIR are superimposed on the power conductors that supply the lights and gates with their electrical energy or transmitted via radio, so that the requirement for additional wiring that might be exposed to the elements or have to be buried is minimized.

While the invention has been described in terms of various specific embodiments, those skilled in the art will recognize that the invention can be practiced with modification within the spirit and scope of the claims.

What is claimed is:

1. An alarm monitor for a railroad grade crossing, the grade crossing including a crossing island and having an island activation relay that is activated in response to an approaching train, said alarm monitor comprising:

a micropower impulse radar (MIR) responsive to pedestrians and motor vehicles in a prohibited area of the crossing island during activations of the island activation relay;

a processor configured to generate a warning signal when the MIR detects a pedestrian or a motor vehicle in the prohibited area during an activation of the island activation relay; and a counter configured to count detections of pedestrians and vehicles within the pedestrian area while the island activation relay is activated.

2. An alarm monitor in accordance with claim 1 wherein the MIR has a detection range of no more than about 30 feet.

3. An alarm monitor in accordance with claim 1 wherein the grade crossing has a gate having a gate arm activated by the island activation relay, and the MIR is mounted on the gate arm.

4. An alarm monitor in accordance with claim 1 wherein the grade crossing has a gate, and the MIR is mounted on the gate.

5. An alarm monitor in accordance with claim 1 wherein the grade crossing has a flasher including a mast, and the MIR is mounted on the flasher mast.

6. An alarm monitor in accordance with claim 1 wherein the grade crossing includes a cantilever over lanes of crossing highway traffic, and the MIR is mounted on the cantilever.

7. An alarm monitor in accordance with claim 1 and having a plurality of MIRs, including at least one central MIR responsive to pedestrians and motor vehicles within a central region of the prohibited area and at least one outer MIR responsive to pedestrians within a crossing region of the prohibited area, and wherein said processor is responsive to said plurality of MIRs to generate a warning signal in response to said at least one central MIR detecting the pedestrian or the motor vehicle only after said outer MIR has detected the pedestrian or the motor vehicle.

8. A alarm monitor in accordance with claim 1 wherein the grade crossing comprises a signaling bungalow, and said processor is mounted within the signaling bungalow.

9. An alarm monitor in accordance with claim 8 wherein the MIR is mounted outside the bungalow and communicates with said processor via a hardwired connection.

10. An alarm monitor in accordance with claim 8 further configured to transmit detection signals from said MIR to said processor using spread spectrum modulation.

11. An alarm system in accordance with claim 10 wherein said transmission is via radio.

12. An alarm system in accordance with claim 10 wherein said transmission is via wire.

13. An alarm system in accordance with claim 10 wherein the grade crossing includes field wiring and a flash relay configured to generate a flash signal voltage over the field wiring, and said system being configured to transmit detection signals from said MIR to said processor using spread spectrum modulation comprises said system being configured to transmit detection signals from said MIR over the field wiring during flash portions of a duty cycle of the flash relay.

14. A method for monitoring alarms at a railroad grade crossing having an island activation relay that is activated in response to an approaching train, comprising the steps of:

detecting reflections from a boundary of a prohibited area of the grade crossing using a microwave impulse radar (MIR) during activations of the island activation relay upon approach of a train;

generating a warning signal when the MIR detects a pedestrian or a motor vehicle in the prohibited area on the condition that the island activation relay has been activated; and counting detections of pedestrians and motor vehicles in the prohibited area while the island activation relay has been activated.

15. A method in accordance with claim 14 further comprising the step of mounting the MIR on a gate arm of the grade crossing, so that, when the gate arm is lowered, the MIR is directed at a boundary of the prohibited area.

16. A method in accordance with claim 14 further comprising the step of transmitting a spread spectrum modulated detection signal from the MIR to a processor that generates the warning signal.

17. A method in accordance with claim 16 wherein the spread spectrum modulated detection signal is transmitted via field wiring during flash portions of a duty cycle of a flash relay generating a flash signal voltage over the field wiring.

18. A method for monitoring alarms at a railroad grade crossing having an island activation relay that is activated in response to an approaching train, comprising the steps of:

detecting reflections from a boundary of a prohibited area of the grade crossing using a microwave impulse radar (MIR) during activations of the island activation relay upon approach of a train;

generating a warning signal when the MIR detects a pedestrian or a motor vehicle in the prohibited area on the condition that the island activation relay has been activated; and separately detecting pedestrians and vehicles in a central region of the prohibited area, and of conditioning generation of the warning signal upon first detecting a pedestrian or vehicle crossing a boundary of the prohibited region and next detecting a pedestrian or vehicle entering the central region of the prohibited area.

* * * * *